US008459953B2

(12) United States Patent
Haffner

(10) Patent No.: US 8,459,953 B2
(45) Date of Patent: Jun. 11, 2013

(54) SEAL PLATE AND BUCKET RETENTION PIN ASSEMBLY

(75) Inventor: Matthew Troy Haffner, Honea Path, SC (US)

(73) Assignee: General Electric Company, Schenectady, NY (US)

( * ) Notice: Subject to any disclaimer, the term of this patent is extended or adjusted under 35 U.S.C. 154(b) by 815 days.

(21) Appl. No.: 12/689,817

(22) Filed: Jan. 19, 2010

(65) Prior Publication Data

US 2011/0176923 A1 Jul. 21, 2011

(51) Int. Cl.
*F01D 5/32* (2006.01)

(52) U.S. Cl.
USPC ..... 416/220 R; 416/219 R

(58) Field of Classification Search
USPC ..... 416/219 R, 220 R, 221
See application file for complete search history.

(56) References Cited

U.S. PATENT DOCUMENTS 3,137,478 A 6/1964 Farrell
3,266,770 A 8/1966 Harlow
3,733,146 A 5/1973 Smith et al.
3,814,539 A 6/1974 Klompas
4,021,138 A 5/1977 Scalzo et al.
4,480,958 A 11/1984 Schlechtweg
4,507,052 A 3/1985 Thompson
4,523,890 A 6/1985 Thompson
4,582,467 A 4/1986 Kisling
4,659,285 A 4/1987 Kalogeros et al.
4,846,628 A 7/1989 Antonellis
5,318,405 A 6/1994 Meade et al.
5,338,154 A 8/1994 Meade et al.
5,800,124 A 9/1998 Zelesky
6,190,131 B1 2/2001 Deallenbach
6,457,942 B1 10/2002 Forrester
6,984,106 B2 1/2006 Thompson
7,264,447 B2 9/2007 Ono et al.

*Primary Examiner* — Dwayne J White
(74) *Attorney, Agent, or Firm* — Nixon & Vanderhye, P.C.

(57) ABSTRACT

A disk for a machine rotor includes a disk body having an outer periphery formed with a plurality of axially-oriented slots; a plurality of buckets, each bucket having an airfoil portion and an attachment portion, the attachment portion loaded axially into a respective one of the plurality of axially-oriented slots. A plurality of arcuate seal plate segments arranged about the outer periphery of the disk body, each covering at least two of the plurality of axially-oriented slots and respective attachment portions of the plurality of buckets. A retention pin extends axially through each of the plurality of arcuate seal plate segments and into an axially oriented bore in the disk body. The retention pin has an inner end engageable with a locking key and adapted to move the locking key into a locking position which prevents axial movement of a pair of adjacent ones of the plurality of buckets.

20 Claims, 4 Drawing Sheets

SEAL PLATE AND BUCKET RETENTION PIN ASSEMBLY

This invention relates to a sealing arrangement for an axial flow fluid turbine or other machine rotor including a rotor wheel or disk having a plurality of axially inserted turbine blades or buckets extending radially from the disk. Specifically, the invention relates to a bucket end seal assembly including a device for attaching a segmented seal plate to a turbine wheel to seal the interface between the bucket and the wheel and to prevent axial movement of the bucket.

BACKGROUND OF THE INVENTION

In an axial flow gas turbine, a plurality of blades or buckets are attached to each of the turbine rotor disks or wheels, often by means of a mated engagement between a dovetail or fir tree-shaped section at the base of the blade or bucket (referred to sometimes herein as an "attachment portion") and a corresponding axially-extending slot formed in the rotor disk. While these arrangements provide excellent radial retention, additional means must be provided for retaining each blade or bucket against axial movement within its respective rotor disk slot. In addition, it is necessary to seal the turbine bucket/turbine wheel attachment interface on the downstream side of the disk. In this regard, cooling air is typically directed into clearance slots or root manifolds in the wheel, inboard of the individual bucket attachments from which it flows into internal cavities of the buckets. While the typical dovetail or fir tree attachment portion of each blade or bucket fits snugly into the corresponding slot in the rotor disk, manufacturing tolerances and differences from blade-to-blade and wheel-to-wheel result in leakage at the ends of the root manifolds between the buckets and the disks. As a result, end cover plates are normally installed to reduce such leakage. It is desirable that such end cover plates be of relatively simple and cost-effective design.

There remains a need for more efficient and more effective means for attaching the seal plates to the turbine rotor wheels or disks not only to seal against leakage but also to provide a locking function such that the buckets cannot move axially within their respective disk slots.

BRIEF DESCRIPTION OF THE INVENTION

In a first exemplary but nonlimiting aspect, the invention relates to a disk for a machine rotor comprising: a disk body having an outer periphery formed with a plurality of axially-oriented slots; a plurality of buckets, each bucket having an airfoil portion and an attachment portion, the attachment portion loaded axially into a respective one of the plurality of axially-oriented slots; a plurality of arcuate seal plate segments arranged about the outer periphery of the disk body, one of the plurality of arcuate seal plate segments covering at least two of the plurality of axially-oriented slots and respective attachment portions of the plurality of buckets; and a retention pin extending axially through the one of the plurality of arcuate seal plate segments and into a respective axially oriented bore in the disk body; said retention pin having an inner end engageable with a locking key and adapted to move the locking key into a locking position which prevents axial movement of a pair of adjacent ones of the plurality of buckets.

In another exemplary but nonlimiting embodiment, there is provided a disk for a machine rotor comprising: a disk body having an outer periphery formed with a plurality of axially-oriented slots; a plurality of buckets, each bucket having an airfoil portion and an attachment portion, the attachment portion loaded axially into a respective one of the plurality of axially-oriented slots; and a plurality of arcuate seal plate segments arranged about the outer periphery of the disk body, one of the plurality of arcuate seal plate segments covering at least two of the plurality of axially oriented slots and respective attachment portions of the plurality of buckets; and at least one retention pin extending axially through the one of the plurality of arcuate seal plate segments and into an axially oriented bore in the disk body; the at least one retention pin having an inner end engageable with a locking key and adapted to move the locking key into a locking position which prevents axial movement of a pair of adjacent ones of the plurality of buckets; wherein the axially oriented bore in the disk intersects a radial slot in the disk body, the locking key located in the radial slot and movable radially outwardly into cut-outs formed, respectively, in the pair of adjacent ones of the plurality of buckets; wherein the at least one retention pin is provided with first and second tabs on respective inner and outer ends thereof, the first and second tabs extending in diametrically opposed directions; wherein the axially oriented bore is formed with a groove along a radially inward side thereof, the groove sized and shaped to accommodate the first tab as said retention pin is moved through the axially oriented bore, the radial slot located to permit the at least one retention pin and the first tab to be rotated so that the first tab moves into engagement with the locking key and moves the locking key radially outwardly into the locking position.

In still another exemplary but nonlimiting embodiment, there is provided a retention pin for securing a bucket and a seal plate segment to a machine rotor disk body comprising: an elongated pin body having an inner end and an outer end, the inner end formed with a first, substantially rectangular tab and the outer end formed with a second, substantially arcuate tab; the first and second tabs extending from the pin body in substantially diametrically-opposed directions.

The invention will now be described in connection with the drawings identified below.

DETAILED DESCRIPTION OF THE INVENTION

Figure 1:
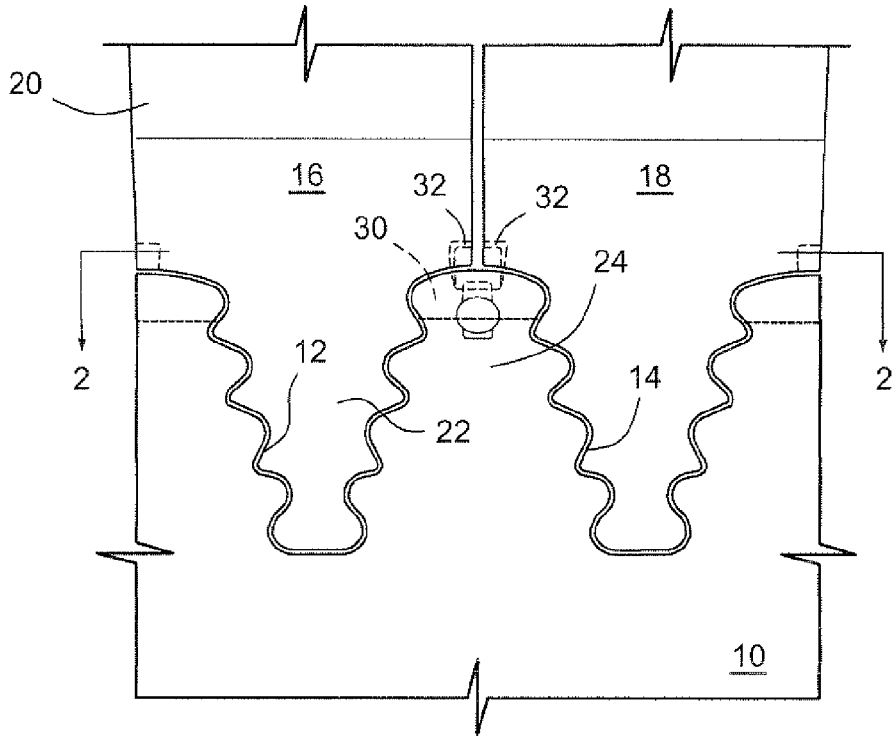
FIG. 1 is a partial end view of a turbine disk and installed buckets showing a retention pin slot and associated locking key (in phantom) in accordance with a first exemplary but nonlimiting example of the invention, but with the end cover plate removed for ease of understanding.
Figure 2:
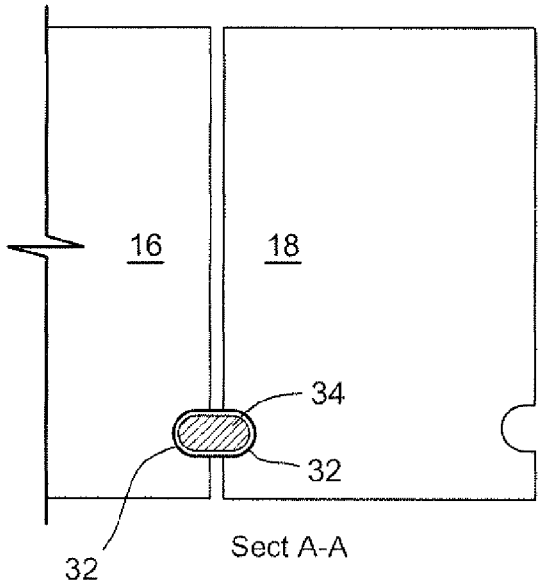
FIG. 2 is a partial section taken along the line 2-2 of FIG. 1.
Figure 3:
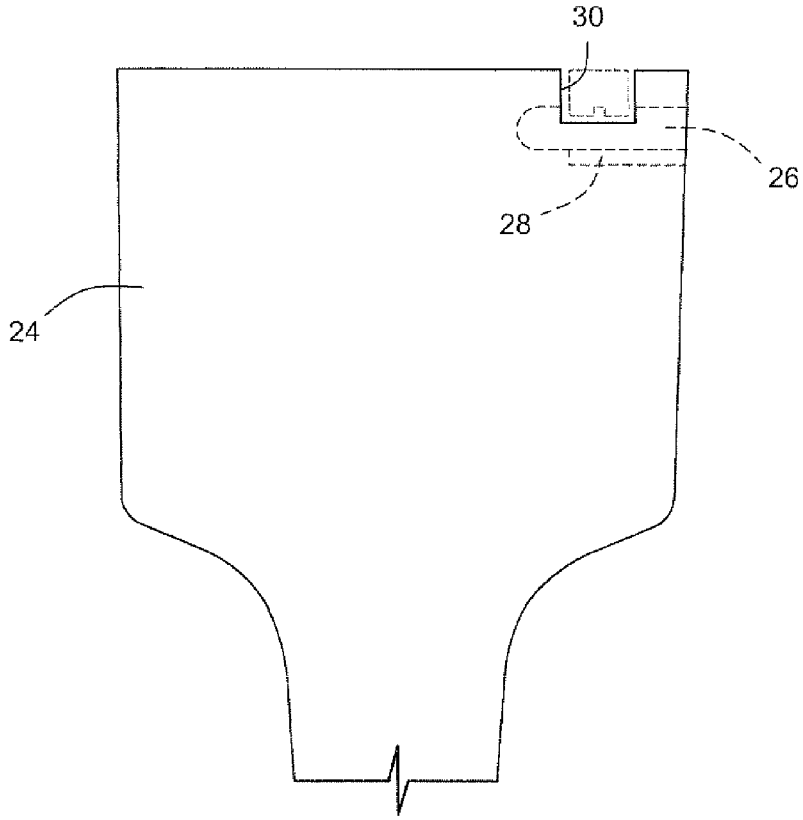
FIG. 3 is a partial section of the outer end of a rotor disk, showing the internal slot configuration for the retention pin of FIG. 1 and showing the associated locking key in phantom.

Referring initially to FIGS. 1-3, there is partially shown the outer periphery of an axial fluid flow turbine rotor wheel or disk 10. The outer periphery of the wheel or disk (or disk body) 10 is formed to include a plurality of circumferentially-spaced apart and axially-extending, so-called "fir-tree" slots (two shown at 12, 14). The fir-tree slots are shaped to receive blades or buckets 16, 18, respectively, each one of which includes an airfoil portion 20 extending radially outwardly from an inner root or attachment portion 22 that is formed to matingly engage its associated fir-tree slot 12 or 14. The bucket configuration per se is well known and need not be described further.

The disk slot arrangement is such that fir-tree shaped posts 24 are formed in the periphery of the wheel or disk 10, circumferentially between each pair of fir-tree shaped slots 12, 14 for example. Each post 24 is machined or otherwise formed to include an axially-extending, substantially round bore 26 (see FIG. 3), having a radially inner grooved portion 28 extending along a portion of its length. The bore 26 intersects a circumferentially-extending slot 30 that extends across the entire width of the post 24 as best appreciated from FIG. 1. Each slot 30 is axially alignable with a pair of cut-outs or recesses 32 formed in adjacent buckets 16, 18 (see FIG. 2), and a locking key 34 is located in the slot 30, and projects radially into the bore 26.

Figure 4:
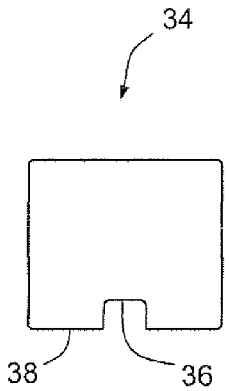
FIGS. 4, 5 and 6 are side, front and plan views, respectively of the locking key shown in FIGS. 1-3.
Figure 5:
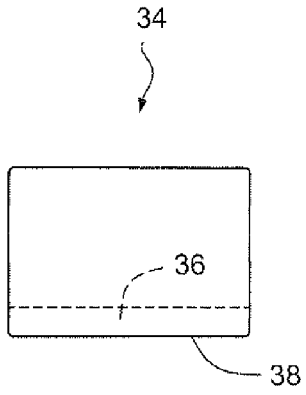
Figure 6:
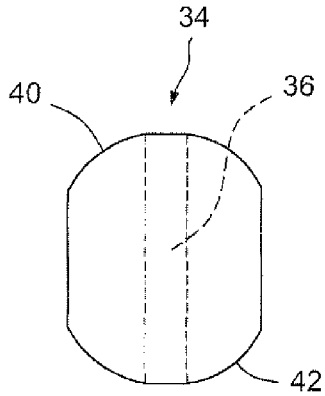

FIGS. 4-6 illustrate in greater detail the locking key 34. The locking key is slightly elongated in the circumferential direction (FIG. 5) and substantially square in transverse cross section (FIGS. 3 and 4), defined by four sides, a radially outer surface and a radially inner surface. A slot 36 runs along the entirety of its lower or radially inner surface 38 in the circumferential direction. Opposite ends (in the circumferential direction) are tapered as at 40, 42 (see FIG. 6).

Figure 7:
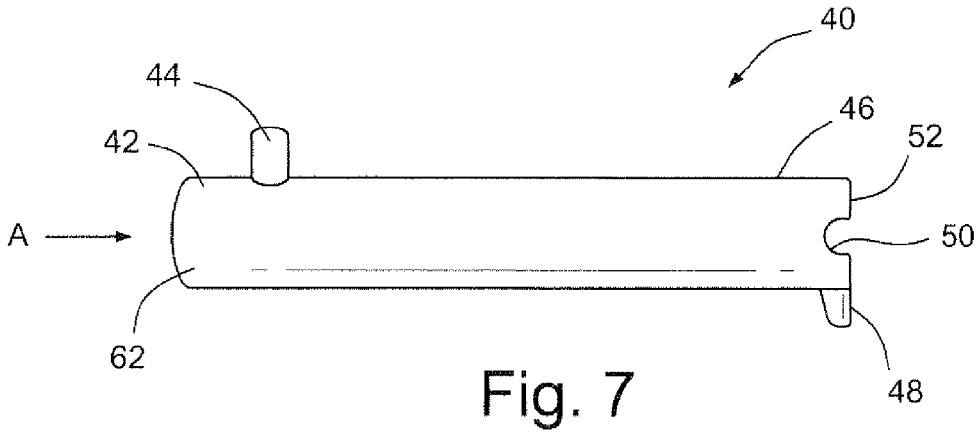
FIG. 7 is a side elevation of the retention pin shown in FIG. 1.
Figure 8:
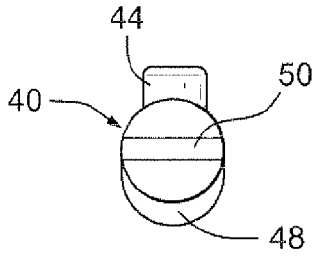
FIG. 8 is a front elevation of the pin shown in FIG. 7.

Turning to FIGS. 7 and 8, a nonlimiting example of a retention pin 40 is illustrated. The elongated retention pin 40 is substantially round in cross section and is formed with a pair of tabs at opposite ends thereof. More specifically, the inner end 42 of the pin (i.e., that end which is inserted into the wheel or disk 10), is provided with a first tab or projection 44 extending radially outwardly (in its finally installed orientation), while the outer end 46 is provided with a second tab or projection 48 extending radially inwardly (also in its finally installed orientation). The first tab 44 has a generally rectangular shape, while the second tab 48 has a generally arcuate shape. A tool slot 50 runs across the end face 52 at the outer end 46, and facilitates rotation of the pin 40 as described in greater detail below.

Figure 9:
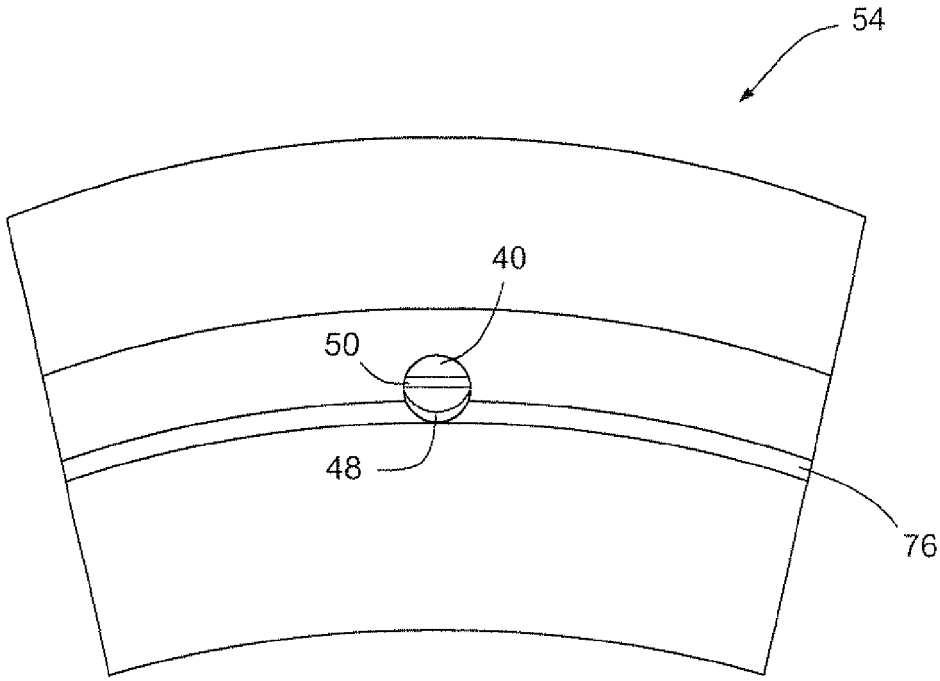
FIG. 9 is a front elevation of the retention pin shown in FIG. 8, inserted through an end cover plate.
Figure 10:
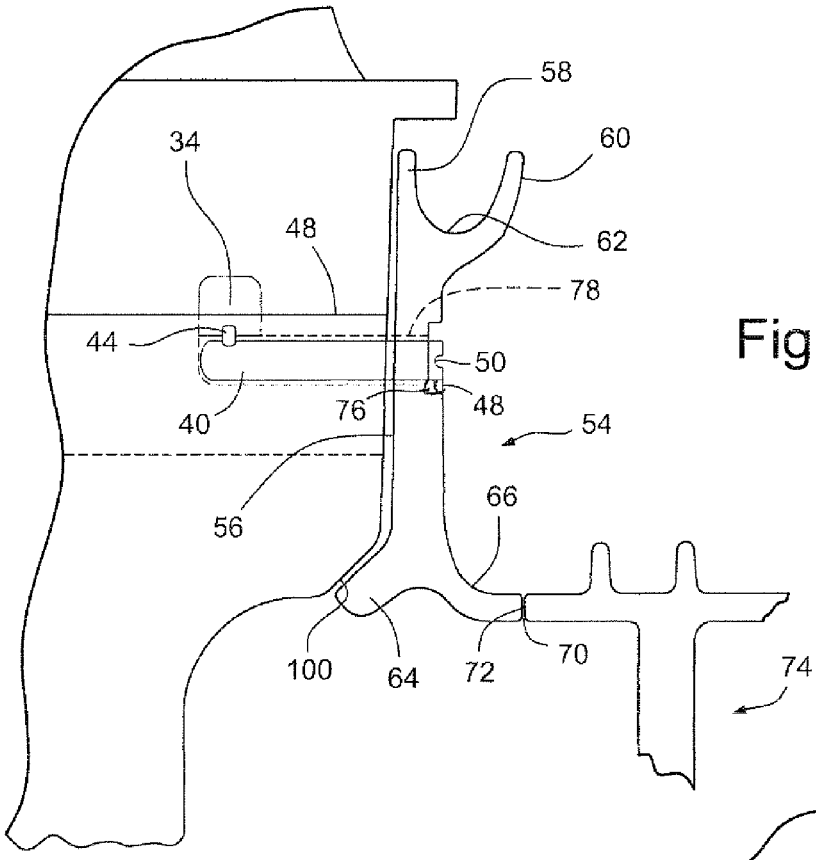
FIG. 10 is a partial side section view illustrating the retention pin and locking key shown in FIGS. 7 and 8 holding a cover plate in place on the turbine disk.

With reference now to FIGS. 9 and 10, a plurality of arcuately-segmented end cover or seal plates 54 are assembled about the rotor disk, each cover or seal plate segment overlapping at least two bucket/disk interfaces. More specifically, and as best seen in FIG. 10, each end cover or seal plate segment 54 in the exemplary but nonlimiting embodiment shown may be provided with a substantially flat inner surface 56 that is adapted to engage the ends of the buckets and adjacent portions of the rotor disk. The radially outer end of each seal plate segment 54 may be formed with a substantially U-shaped cross section in an end view as shown in FIG. 10) defined by an inner leg 58 and an outer leg 60 defining a circumferentially-extending groove 62 therebetween. The radially inner end of the seal plate segment 54 includes a first, axially and inwardly-directed leg portion 64 and an axially outwardly-directed leg portion 66 terminating at an edge 70 that is adapted to closely align with and essentially seal with an edge 72 of an annular spacer 74. Midway between the ends of the seal plate segment, there is a circumferentially-extending staking groove or slot 76 which intersects the through-aperture 78 that is adapted to align with the bore 26 in the post 24. While one aperture 78 is shown for the seal plate segment 54, it will be appreciated that more than one aperture may be provided to accommodate a like number of retention pins 40, a circumstance dependent on the arcuate extent of each seal plate segment. Upon assembly, the tab 48 of the retention pin 40 is bent or staked into the staking groove 76 to prevent rotation of the pin during operation of the turbine.

In use, after the locking key 34 and adjacent buckets 34 are installed on the wheel or disk, the seal plate segment 54 is located and oriented vis-à-vis the turbine disk, with the bore 78 aligned with bore 26, the retention pin 40 is inserted through the bore 78 and pushed through the bore 26, with the diametrically-opposed tabs 44, 48 reversed relative to the orientation shown in FIG. 7 so that the tab 44 slides along the radially inner grooved portion 28 of the bore 26. Once fully inserted, the retention pin 40 rotated 180 degrees by a tool engaged in the slot 50, so that the tab 44 engages the groove 36 in the locking key 34 and pushes it radially outwardly to the position shown in FIG. 3. At the same time, the arcuate outer tab 48 is rotated into engagement with the lower edge or shoulder of the slot 76 in the seal plate segment. As a result, the interaction between the tab 44 seated in locking key slot 36, the locking key 34 projecting into slot 30, and the tab 48 engaged with the seal cover segment 54 serves to hold the seal plate segment 54 in place against the disk and also prevent axial movement of the adjacent buckets 16, 18 within their respective slots 12, 14.

Figure 11:
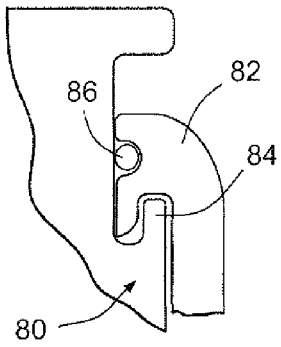
FIG. 11 is a side section detail showing an alternative end cover plate sealing arrangement.
Figure 12:
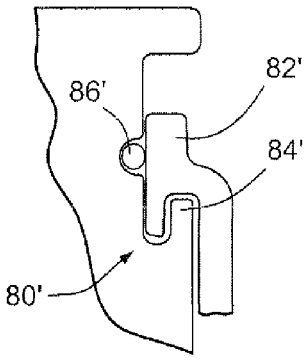
FIG. 12 is a side section detail showing another alternative end cover plate sealing arrangement.

FIGS. 11 and 12 illustrate alternative seal plate configurations which enable mounting to the wheel or disk with a bayonet feature 80 or 80' at the radially outer ends of the seal plate segments. In each case, a hook 82 or 82' engages and loads radially on a lip or rim 84, 84', respectively, formed on the disk, facilitating retention during assembly. In addition, each configuration may incorporate (FIG. 11), or cooperate with (FIG. 12), a seal 86 or 86' to minimize leakage along the bucket attachment portions.

Figure 13:
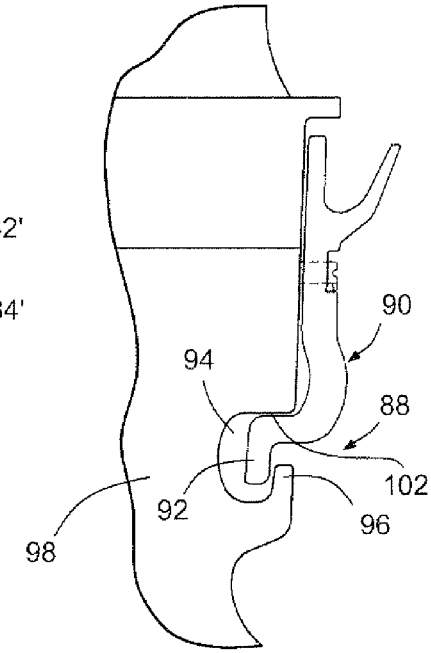
FIG. 13 is a partial side section showing another end cover plate configuration for use with the retention pin and locking key assembly shown in FIGS. 1-8.

FIG. 13 shows another bayonet-type attachment feature at 88, at the radially inner end of an otherwise similar seal plate segment 90, where an offset inner edge is seated in a recess 94, behind a rim 96 formed on the disk body 98 and defining part of the recess 94. The rim 96 keeps the seal plate segment from sliding axially off the disk body during assembly.

During operation of the turbine, the seal plate segments 54 in FIGS. 10-12 load radially on the inclined surface 100 of the post 24 of disk 10, while the seal plate segment 90 in FIG. 13 loads on the horizontal surface 102 of the disk body 98.

It will be appreciated that the arcuate extent of the seal plate segments and the exact sealing configuration between the seal plate segments and turbine wheel or disk may vary with specific applications. In addition, the end edges of the seal plate segments themselves may engage end edges of adjacent seal plate segments or they may overlap.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A disk for a machine rotor comprising: a disk body having an outer periphery formed with a plurality of axially-oriented slots; a plurality of buckets, each bucket having an airfoil portion and an attachment portion, said attachment portion loaded axially into a respective one of said plurality of axially-oriented slots; a plurality of arcuate seal plate segments arranged about said outer periphery of said disk body, one of said plurality of arcuate seal plate segments covering at least two of said plurality of axially-oriented slots and respective attachment portions of said plurality of buckets; and a retention pin extending axially through said one of said plurality of arcuate seal plate segments and into a respective axially oriented bore in said disk body; said retention pin having an inner end engageable with a locking key and adapted to move said locking key into a locking position which prevents axial movement of a pair of adjacent ones of said plurality of buckets.

2. The disk of claim 1 wherein said axially oriented bore in said disk body intersects a radial slot in said disk body, said locking key located in said radial slot and movable radially outwardly into cut-outs formed, respectively, in said pair of adjacent ones of said plurality buckets.

3. The disk of claim 2 wherein said retention pin is provided with first and second tabs on respective inner and outer ends thereof, said tabs extending in diametrically opposed directions.

4. The disk of claim 3 wherein said axially oriented bore is formed with a groove along a radially inward side thereof, said groove sized and shaped to accommodate said first tab on said retention pin as said retention pin is moved through said axially oriented bore, said radial slot located to permit said retention pin to be rotated so that said first tab moves into engagement with said locking key and moves said locking key radially outwardly into said locking position.

5. The disk of claim 4 wherein said second tab is engageable with an outer surface of said one of said plurality of arcuate seal plate segments to hold said one arcuate seal plate segment in place against said disk body.

6. The disk of claim 1 wherein said retention pin is formed with a tool engagement slot across an end face at an outer end thereof.

7. The disk of claim 3 wherein said locking key has four sides, a radially outer surface and a radially inner surface, said radially inner surface formed with a groove adapted to receive said first tab.

8. The disk of claim 5 wherein said second tab engages a shoulder formed in said one of said plurality of arcuate seal plate segments when said locking key is in said locking position.

9. The disk of claim 1 wherein said one of said plurality of arcuate seal plate segments is formed with a hook portion at the radially outer end, radially supported on a lip formed on said disk body.

10. The disk of claim 9 wherein a seal element is interposed between said disk body and said one of said plurality of arcuate seal plate segments at said radially outer end thereof.

11. The disk of claim 1 wherein said one of said plurality of arcuate seal plate segments is formed with an offset radially inner edge seated in a recess formed in said disk body.

12. The disk of claim 1 wherein said one of said plurality of arcuate seal plate segments includes an axially projecting flange at its radially inner end adapted to interface an adjacent spacer.

13. A disk for a machine rotor comprising: a disk body having an outer periphery formed with a plurality of axially-oriented slots; a plurality of buckets, each bucket having an airfoil portion and an attachment portion, said attachment portion loaded axially into a respective one of said plurality of axially-oriented slots; and a plurality of arcuate seal plate segments arranged about said outer periphery of said disk body, one of said plurality of arcuate seal plate segments covering at least two of said plurality of axially oriented slots and respective attachment portions of said plurality of buckets; and at least one retention pin extending axially through said one of said plurality of arcuate seal plate segments and into an axially oriented bore in said disk body; said at least one retention pin having an inner end engageable with a locking key and adapted to move said locking key into a locking position which prevents axial movement of a pair of adjacent ones of said plurality of buckets; wherein said axially oriented bore in said disk intersects a radial slot in said disk body, said locking key located in said radial slot and movable radially outwardly into cut-outs formed, respectively, in said pair of adjacent ones of said plurality of buckets; wherein said at least one retention pin is provided with first and second tabs on respective inner and outer ends thereof, said first and second tabs extending in diametrically opposed directions; wherein said axially oriented bore is formed with a groove along a radially inward side thereof, said groove sized and shaped to accommodate said first tab as said retention pin is moved through said axially oriented bore, said radial slot located to permit said at least one retention pin and said first tab to be rotated so that said first tab moves into engagement with said locking key and moves said locking key radially outwardly into said locking position.

14. The disk of claim 13 wherein said second tab is engageable with an outer surface of said one of said plurality of arcuate seal plate segments to hold said one of said plurality of arcuate seal plate segments in place against said disk body when said locking key is in said locking position.

15. The disk of claim 13 wherein said at least one retention pin is formed with a tool engagement slot across an outer end face thereof.

16. The disk of claim 13 wherein said one of said plurality of arcuate seal plate segments is formed with a hook portion at a radially outer end, radially supported on a lip formed on said disk body.

17. The disk of claim 16 wherein a seal element is interposed between said disk body and said one of said plurality of arcuate seal plate segments at said radially outer end.

18. The disk of claim 13 wherein said one of said plurality of arcuate seal plate segments is formed with an axially offset radially inner edge seated in a recess formed in said disk body.

19. The disk of claim 13 wherein a radially inner end of said one of said plurality of arcuate seal plate segment includes a flange adapted to interface an adjacent spacer.

20. A retention pin for securing a bucket and a seal plate segment to a machine rotor disk body comprising: an elongated pin body having an inner end and an outer end, said inner end formed with a first, substantially rectangular tab and said outer end formed with a second, substantially arcuate tab; said first and second tabs extending from said pin body in substantially diametrically-opposed directions.

* * * * *

UNITED STATES PATENT AND TRADEMARK OFFICE

CERTIFICATE OF CORRECTION

PATENT NO. : 8,459,953 B2
APPLICATION NO. : 12/689817
DATED : June 11, 2013
INVENTOR(S) : Matthew Troy Haffner It is certified that error appears in the above-identified patent and that said Letters Patent is hereby corrected as shown below:

In the Specifications

At column 3, line 44, delete "inner end 42 of the pin" and insert --inner end 42 of the pin 40--

At column 3, line 64, delete "in an end view as shown in FIG. 10)" and insert --(in an end view as shown in FIG. 10)--

At column 4, line 46, delete "where an offset inner edge is seated" and insert --where an offset inner edge 92 is seated--

Signed and Sealed this
Twenty-third Day of July, 2013

Teresa Stanek Rea
*Acting Director of the United States Patent and Trademark Office*